United States Patent [19]

Sevington

[11] Patent Number: 4,752,082

[45] Date of Patent: Jun. 21, 1988

[54] SKIS

[76] Inventor: David Sevington, 5 Court Close, Corscombe, Dorchester, Dorset, United Kingdom, DT2 0PE

[21] Appl. No.: 72,538

[22] Filed: Jul. 13, 1987

[51] Int. Cl.[4] ..... A63C 5/04

[52] U.S. Cl. ..... 280/608; 280/809; 441/68

[58] Field of Search ..... 280/607, 608, 609, 601, 280/809; 441/68, 79

[56] References Cited

U.S. PATENT DOCUMENTS

| | | | |
|---|---|---|---|
| 1,723,693 | 8/1929 | Fröholm | 280/608 |
| 3,063,728 | 11/1962 | Patterson | 280/608 |
| 3,099,025 | 7/1963 | Merkley et al. | 441/79 X |
| 3,148,392 | 9/1964 | Bennett | 441/68 |
| 3,761,980 | 10/1973 | Silverstein | 441/79 X |
| 3,871,671 | 3/1975 | Bildner | 280/608 |

*Primary Examiner*—John J. Love
*Assistant Examiner*—Michael Mar
*Attorney, Agent, or Firm*—Beehler, Pavitt, Siegemund, Jagger, Martella & Dawes

[57] ABSTRACT

A ski has at least two downwardly-extending projections (10, 16, 16B), at least one on each side of the longitudinal axis of the ski, these being integral with the remainder of the ski or provided on one or more separate members, for example on an inverted channel member (7), the base (7A) of the channel, on the upper side of the channel member (7), lying above and being secured to the tail (1) of the ski, which extends between the side walls (7B) of the channel member (7). When the ski is placed on a flat horizontal surface, with the running face (3) of the ski lowermost, the tips (10A, 16A) of the projections (10, 16, 16B), at the lowermost extremities of the projections, will be separated only by an air gap from the surface.

7 Claims, 1 Drawing Sheet

SKIS

This invention relates to skis, a term which is intended to cover snow skis and water skis, both of the kind in which the skier has two skis, one for each foot, and so-called mono-skis, where the skier stands with both feet on a single ski.

An object of the invention is to make turning whilst skiing easier and less likely to result in a fall, especially for a beginner.

According to a first aspect of the invention, there is provided a ski characterised in that in its rear half there are two downwardly-extending projections, one on each side of the longitudinal axis of the ski, and the ski is such that when it is placed on a flat horizontal surface, with the running face of the ski lowermost, the tips of the projections, at the lowermost extremities of the projections, will be separated only by an air gap from said surface.

The ski may be constructed with the projections as an integral part of it or the ski may be constructed without the projections (in which case it may be a conventional ski) and may have attached to its tail a separate member or separate members which provides or provide the projections.

For the case where it is a single separate member which provides the projections, there is provided, according to a second aspect of the invention, an inverted channel member having a flat base and two depending side walls, characterised in that the side walls are spaced apart by a distance a little greater than the width of the tail of a conventional ski, each side wall having a number of recesses in its lower edge between which are formed spaced apart projections extending downwardly from the base, the channel member being such that it may be secured to the tail of a conventional ski, with the inside of the base lying on the upper surface of the tail of the ski, and then when the ski is placed on a flat horizontal surface, with the running face of the ski lowermost, the tips of the projections, at the lowermost extremities of the projections, will be separated only by an air gap from said surface.

Examples in accordance with the invention are described below with reference to the accompanying drawings, in which.

Figure 1:
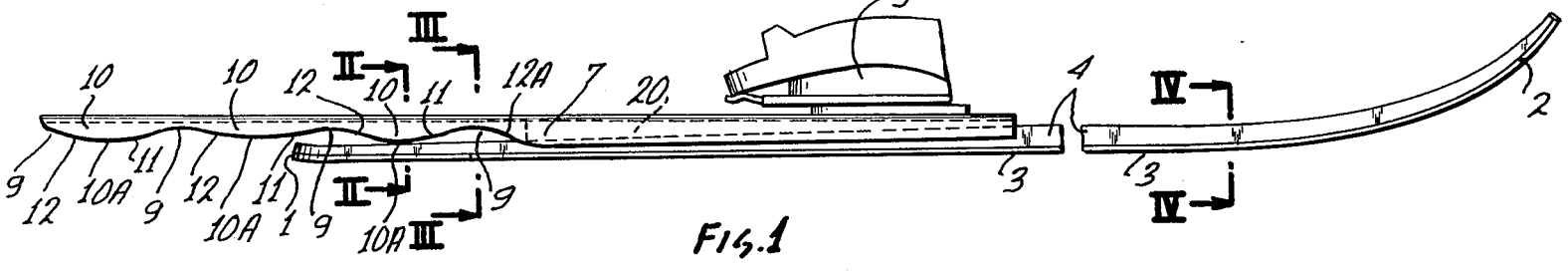
FIG. 1 shows a side view of a snow ski.
Figure 4:
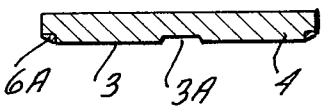
FIGS. 2, 3 and 4 show cross-sectional views of the ski taken where indicated by the arrows II, III and IV of FIG. 1, and FIGS. 5 and 6 show longitudinal sectional views of the rear ends of two further snow skis.
Figure 3:
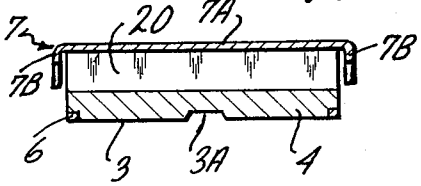
Figure 2:
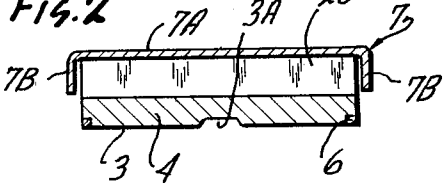

The ski shown in FIGS. 1 to 4 has a slightly upturned tail 1 and an upturned nose 2, the width of the running surface 3 being greatest at the front and the thickness of the main part 4 of the ski being greatest near the middle and decreasing, proceeding from the thickest part towards both ends. The running surface 3 has a recess 3A running along it. The parts 1 to 4 are conventional except for the edges of the part 4. The bindings 5 (only partly shown) for the heel of the ski boot are conventional but nearer the tail of the ski than is customary, as are the bindings (not shown) for the toe.

Attached to the ski is an inverted channel member 7 made of sheet metal, the channel member having a flat base 7A and two side walls 7B which depend from it, are approximately perpendicular to it and are spaced apart by a distance a little greater than the width of the tail of the ski. The inside face of the flat base 7A lies on the upper surface of the tail of the ski but is spaced from it by a spacer 20. Each side wall 7B has four recesses 9 in its lower edge, whereby three projections 10 are formed projecting downwardly from the base 7A. The projections are elongate, their length direction being substantially parallel to the longitudinal axis of the ski. Each projection has a convex forward lower edge 11, which extends in a smooth curve both upwardly and forwardly from the lowest extremity 10A of the projection 10, and a convex rearward lower edge 12, which extends in a smooth curve both upwardly and rearwardly from the extremity 10A. The foremost recess 9 in each side wall 7B is bounded by an edge 12A like the edges 12. If the ski is placed on a flat horizontal surface, with the running surface 3 of the ski lowermost, the lowermost extremity 10A of each projection 10 will be separated only by an air gap, preferably at least 2 millimetres wide, for example 5 to 10 millimetres wide, or even 20 millimetres or more wide, from that flat surface. The projections 10 may have vertical heights between 2 and 10 mm or less or greater.

The bindings 5 for the heel of the ski boot are above the forward end of the channel member 7 and the channel member 7 extends rearwardly beyond the tail 1 of the ski by more than 10 cm. The length of the channel member 7 is about a quarter or a third of the total length of the assembly of channel member and ski, although it could be a smaller or larger proportion, say between 5% and 60%, of the total length of the assembly.

The usual steel inserts 6 along the lower edges of the ski have vertical edges below the base 7A of the channel member 7 and edges 6A which are not vertical but inclined, for example by 70° to 80°, to the vertical in front of the channel member 7.

Figure 5:
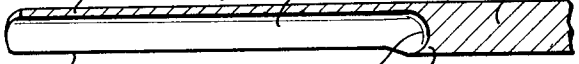

FIG. 5 shows an inverted channel part 14 at the rear of the ski, comprising a base 15 and two depending side walls 16, all integral with the main part 4 of the ski. Instead of each side wall 16 providing three projections, it provides only one projection which has an approximately straight lower extremity 16A. The rear end of the main part 4 of the ski is formed with a recess 18 which is bounded on its lower side by a rearwardly facing tongue 19 which extends across the ski and assists a skier in climbing a hill.

Figure 6:
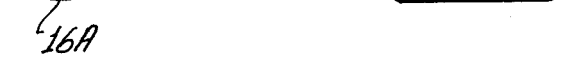

The construction shown in FIG. 6 is like that of FIG. 5 but here each side wall 16 provides two distinct projections 16B, like the projections 10, with lower extremities 16A.

In each of the examples shown in FIGS. 5 and 6, if the ski is placed on a flat horizontal surface with the running surface 3 of the ski lowermost, the lowest extremities 16A of the projections will be spaced only by an air gap, preferably at least 2 mm wide, from the flat surface.

In the case of a snow ski it seems preferable for there to be in the rear half of the ski a plurality of the downward projections, such as the projections 10 or 16B, on each side of the longitudinal axis of the ski, the projections on each side of the axis being spaced apart in a direction substantially parallel to the axis. With such a construction, the skier can make a turn by leaning backwards and turning the feet and the upper body in the intended new direction of travel. It is not necessary to put all or most of the weight on the lower ski.

In the case of a water ski it seems preferable for there to be only one elongate downward projection on each side of the axis of the ski.

I claim:

1. For attachment to the upper surface of at least a portion of a ski having a turned up forward edged section, a trailing edged section with a tail end, an intermediate edged section, the top of which latter section is provided with foot receiving means, and a running bottom face: an inverted channel member comprising a horizontal base portion slightly greater in width than the width of the ski and extending from said intermediate section to a point beyond the tail end of the ski, said channel member having a pair of side walls one of which depends downwardly from each side of the horizontal base portion in such manner that, when said base portion is secured on top of the intermediate and trailing sections of the ski, said side walls are disposed parallel to the side edges of the last said ski sections; each of said slide walls having at least one recess on its lower edge and defining at least one projection extending downwardly from the base portion, the depth of each said projection being such that, when the running bottom face of the ski is laid on a flat horizontal surface, the lowermost tip of each said projection will be spaced slightly from and above, said flat surface and the plane of the running bottom face thereon to provide an air gap between said tip and said flat surface.

2. The inverted channel member as described in claim 1 wherein each of said side walls defines a plurality of projections spaced apart from each other and extending downwardly from said base portion, the depth of each of said projections being such that when said base portion of the channel member is placed over and secured to the top surface of the intermediate and trailing sections of the ski, and the running bottom face of the ski is placed on a flat horizontal surface, the lowermost tips of the projections will be spaced slightly from, and above, the last said surface and the plane of the running bottom face to provide air gaps between said tips and said flat surface.

3. A channel member as described in claim 2 wherein the projections are elongated in a direction parallel to the side edges of the ski sections.

4. A channel member as described in claim 2 or claim 3 wherein each projection is spaced apart from the adjacent projections.

5. A channel member as described in claim 4 wherein each projection has a forward convex lower edge which extends in a smooth curve both upwardly and forwardly, and a convex rearward lower edge which extends in a smooth curve both upwardly and rearwardly.

6. A channel member as described in claim 1 wherein the channel member extends rearwardly of the tail of the trailing section of the ski by at least 10 cm.

7. A channel member as described in claim 2 wherein the depth of each projection is between 2 to 10 millimeters.

* * * * *